United States Patent [19]

Koepke

[11] 4,370,002

[45] Jan. 25, 1983

[54] ATTACHMENT FOR CHAIR ARM

[75] Inventor: Earl H. Koepke, Burr Oak Township, St. Joseph County, Mich.

[73] Assignee: Kimball International, Inc., Jasper, Ind.

[21] Appl. No.: 158,746

[22] Filed: Jun. 12, 1980

[51] Int. Cl.[3] ..... A47C 27/00

[52] U.S. Cl. ..... 297/452; 5/403; 297/218; 297/226; 297/416; 297/440

[58] Field of Search ..... 248/345.1; 297/452, 297/DIG. 1, DIG. 2, 441, 440, 416, 421, 218, 226, 219; 160/389, 390, 392, 395; 5/402, 403, 404, 405, 406, 407, 408

[56] References Cited

U.S. PATENT DOCUMENTS

| | | | |
|---|---|---|---|
| 1,230,948 | 6/1917 | Turner | 5/403 |
| 1,756,579 | 4/1930 | Wisner | 5/404 |
| 2,005,454 | 6/1935 | Clark | 5/405 |
| 2,099,200 | 11/1937 | Findora | 5/404 |
| 2,354,728 | 8/1944 | Asaro | 5/403 |
| 2,876,826 | 3/1959 | Neely et al. | 5/404 |
| 3,027,196 | 3/1962 | Hamilton | 297/421 |
| 3,041,109 | 6/1962 | Eames et al. | 297/452 |
| 3,082,038 | 3/1963 | Sanderson | 297/452 X |
| 3,233,253 | 2/1966 | Cauvin | 5/402 |
| 3,273,178 | 9/1966 | Baruth et al. | 5/403 |
| 3,298,743 | 1/1967 | Albinson et al. | 297/452 X |
| 3,300,251 | 1/1967 | Helms | 297/452 X |
| 3,341,251 | 9/1967 | Costin | 297/452 |
| 3,512,834 | 5/1970 | Lockshin | 297/452 |
| 3,633,968 | 1/1972 | Sears, Jr. | 5/403 X |
| 3,758,159 | 9/1973 | Morris | 5/403 X |
| 3,869,106 | 4/1975 | Gregov | 248/345.1 |
| 4,073,539 | 2/1978 | Caruso | 297/DIG. 2 |

FOREIGN PATENT DOCUMENTS

| | | | |
|---|---|---|---|
| 125188 | 8/1947 | Australia | 5/407 |
| 2985558 | 10/1979 | Fed. Rep. of Germany | 297/441 |
| 1240875 | 8/1960 | France | 297/226 |

*Primary Examiner*—James T. McCall

*Attorney, Agent, or Firm*—Gust, Irish, Jeffers & Hoffman

[57] ABSTRACT

A connection for securing upholstery and an arm to an article of furniture. A body supporting frame is provided which includes a continuous channel extending along the peripheral edge of the frame. An elongated strip is adapted to be secured to the frame and projects partly into the channel to restrict the opening into the channel. A compressible welt cord is utilized and has a width dimension at least greater than the restricted dimension into the channel. Upholstery covers at least a portion of the frame and has an edge portion thereof received into the channel. The welt cord is utilized to effect a securement of the upholstery to the frame. The arm has a bracket with an extension member thereon which extends through an opening in the upholstery and between the frame and a fastener member. The fastener member effects a clamping of the extension member between the fastener and the frame. The fastener member which is utilized to effect a clamping of the extension member, as aforesaid, lies in the channel and is covered by the welt cord when the article of furniture is fully covered.

5 Claims, 6 Drawing Figures

ATTACHMENT FOR CHAIR ARM

FIELD OF THE INVENTION

This invention relates to a connection for securing upholstery and an arm to an article of furniture, such as a chair.

BACKGROUND OF THE INVENTION

This invention arose out of a need to simplify and make less expensive the making of an article of furniture, such as a chair, wherein upholstery is to be stretched over a body supporting frame and an arm attached to the chair. Heretofore, the body supporting frame has consisted of a contoured shell, usually a molded thermoplastic shell having a desired contour. The shell had a channel along the peripheral edge thereof and received structure in the channel for tightly holding the upholstery to the frame. U.S. Pat. No. 3,298,743 discloses this general type of chair construction. One of the problems encountered in manufacturing the thermoplastic frame is that the width dimension of the channel adjacent the outer end thereof had to be narrower than the bottom dimension in order to receive and hold a compressible welt cordlike member therein. The relaxed dimension of the compressible welt cord has a dimension which is at least greater than the restricted dimension at the outer end of the channel. As a result, the welt cord must be compressed in order to permit it to enter into the channel. During the manufacture of the frame having the aforesaid type of channel therein, complicated molding requirements were necessitated in order to effect a molding of the channel and causing it to have a width dimension at the outer region thereof less than the width dimension at the bottom end. Accordingly, Applicant desires to provide a simpler and less expensive way of making the body supporting frame having a channel therein comply with the desired dimensional characteristics.

Heretofore, an arm member for furniture had a bracket secured thereto, which bracket had an extension member extending through an opening in the upholstery to a position adjacent the frame. The extension member had an internally threaded hole therethrough and received the threaded portion of a screw therein. The screw was received in a hole in the bottom of the aforesaid channel, however, a problem arose in aligning the internally threaded hole in the extension member on the bracket with the hole in the bottom wall of the channel because both are, at this time of the assembly, covered by the upholstery. If a plurality of brackets were provided on the arm, strict dimensional tolerances had to be maintained in order to effect a simultaneous alignment of all of the holes in the various extension members with the holes already molded into the frame. If the holes were not molded into the frame, a problem arose in enlarging the hole in the frame or shifting the hole in the extension member so that alignment would be achieved.

Accordingly, a need has arisen to satisfy this particular problem in an expeditious and inexpensive manner.

Accordingly, the objects of this invention include:

1. To provide a channel in a body supporting frame having a characteristic wherein the width dimension adjacent the outer end of the channel is less than the width dimension adjacent the bottom of the channel without necessitating complicated and expensive molding techniques in order to achieve the dimensional requirements.

2. To provide a connection for an appendage to an article of furniture, such as an arm, wherein the connection can be simply obtained without any problems of alignment with the means for effecting a securement of the appendage to the article of furniture.

It is further an object of the invention to provide a connection for both securing the upholstery to the body supporting frame, as well as securing the appendage to the body supporting frame, which is durable and will not become loose through prolonged usage of the article of furniture.

SUMMARY OF THE INVENTION

The objects and purposes of the invention are met by providing a connection for securing upholstery to an article of furniture and a further connection for securing an appendage to the aforesaid article of furniture. Body supporting frame means are provided which have a continuous channel extending about and having a width dimension crosswise of the longitudinal extent of the channel that is at least equal to or greater than the width of the channel adjacent the bottom thereof. An elongated strip having an angular configured surface on one side thereof is provided, which surface conforms to the shape of the outer edge of the channel on one side thereof, with means being provided for securing the angular configured surface to the outer edge surface. The elongated strip has structure thereon which projects across the width of the channel adjacent the outer part to restrict the opening near the outer part thereof. A compressible welt cord is provided having a width dimension at least greater than the restricted outer part of the opening. Upholstery is provided for covering at least a portion of the body supporting frame with an edge portion of the upholstery covering the aforesaid elongated strip and being received in the channel. The welt cord means is also received in the channel inside of the elongated strip and the restricted outer part of the opening. The compressibility of the welt cord means effects a clamping of the material of the upholstery between the welt cord means and the wall of the channel and further effects a securement of the upholstery to the body supporting frame means. A hole is provided in the bottom wall of the channel and receives an elongated fastener member therethrough having a head on one end thereof which lies in the channel. A further fastener member is provided and operatively cooperates with the first-mentioned fastener member to draw the further fastener member toward the body supporting frame means. A bracket is secured to the appendage and has an extension member thereon extending through an opening in the upholstery and between the further fastener member and the body supporting means so that a clamping of the extension member between the further fastener member and the body supporting means is effected. The welt cord means effects a covering of the head in the channel so that it is not exposed when the article of furniture is fully covered.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
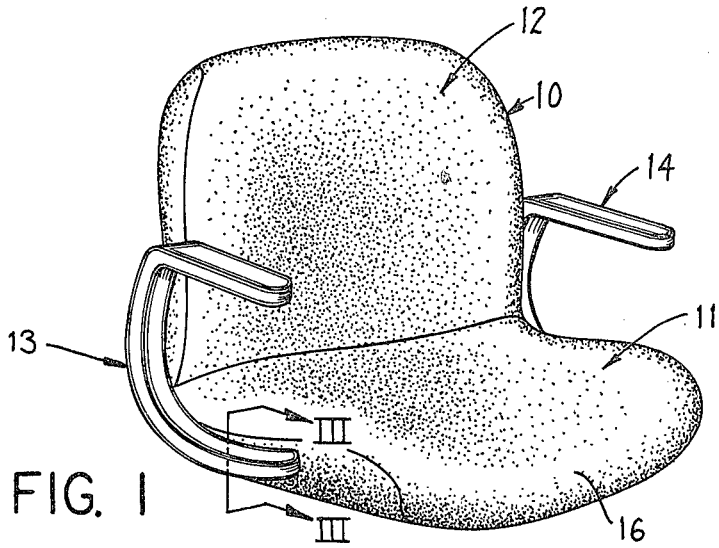
FIG. 1 is a perspective view of a chair embodying the invention.
Figure 2:
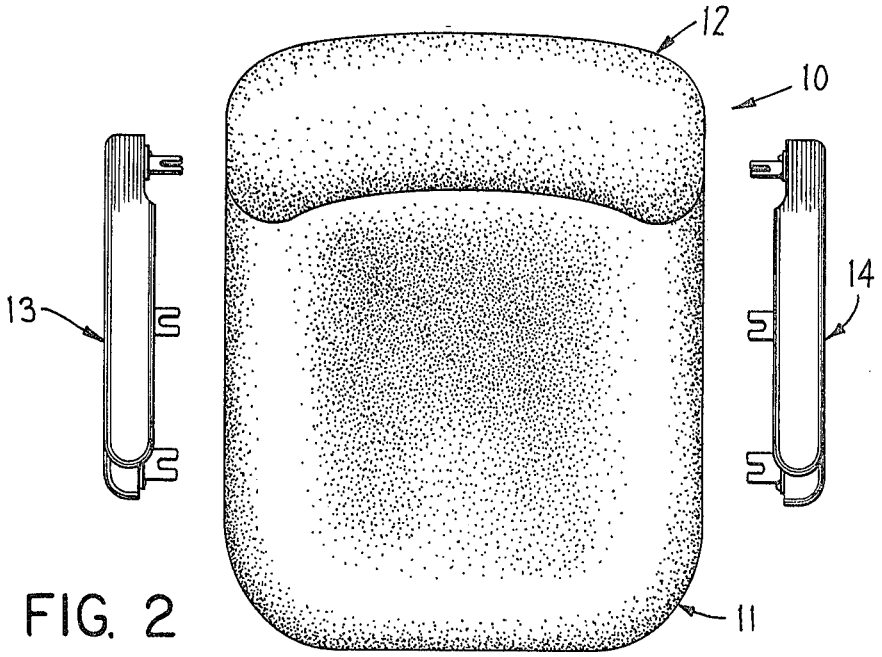
FIG. 2 is an exploded view of the chair with the two side appendages separated from the body supporting portion of the chair.
Figure 3:
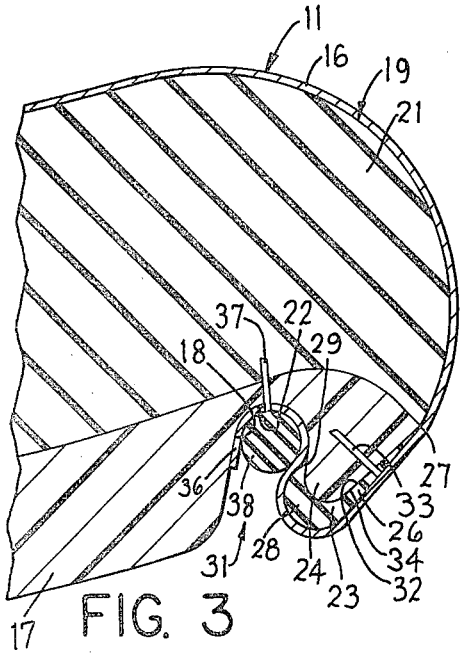
FIG. 3 is a sectional view taken along the line III—III of FIG. 1.

A chair 10 embodying the invention is illustrated in FIG. 1 and has a seat portion 11, a back portion 12 secured to the seat portion 11, and a pair of laterally spaced arms 13 and 14 secured to the seat portion 11 and back portion 12. The seat portion 11 and the back portion 12 are constructed in a generally similar manner. Therefore, and for purposes of simplifying this disclosure, Applicant is describing the connection of the upholstery 16 to the chair 10 by referring to the structure illustrated in FIG. 3.

More specifically, the seat portion 11, for example, has a body supporting frame member 17 which is made of a moldable thermoplastic material having an elongated and continuous channel 18 provided along a peripheral edge thereof. A cushion 19 includes a resilient cushioning element 21, preferably of foam rubber, adhesively, if desired, secured to the body supporting frame member 17.

The channel 18 in the body supporting frame 17 has a generally uniform width dimension from the outer region thereof down to the bottom wall 22. The reason for providing this uniform width channel 18 is that it is simpler and less expensive to mold. In addition to the foregoing, an elongated strip 23 of pliable material has been provided, such as rubber, which lines an edge 24 of the channel 18. The strip 23 has a generally J or U-shaped configuration with the stem portion 26 tapering to a linelike edge as at 27 and the curved portion 28 also tapering to a linelike edge as at 29. The curved portion 28 of the elongated strip 23 projects into the opening 31 adjacent the outer part of the channel 18 to restrict the cross width thereof adjacent the outer portion of the channel 18. As a result, the cross width dimension of the channel 18 adjacent the outer portion thereof is less than the width of the channel 18 adjacent the bottom wall 22. The surface 32 on the inside of the elongated strip 23 has a contour which conforms to the outer contour of the edge portion 24 of the channel 18 on the body supporting frame 17. The elongated strip 23 is secured to the frame 17 by means of plural staples 33. If desired, the stapled connection, as at 33, can be further enhanced through the utilization of an adhesive between the contoured surface 32 on the inside of the elongated strip 23 and the contoured surface 34 on the frame 17.

The upholstery 16 is laid over the cushioning element 19 and at least the exposed portion of the frame 17 and the elongated strip 23 covering an edge portion 24 of the channel 18. An edge portion 36 of the upholstery 16 is received in the channel 18 and is secured therein by means of plural staples 37 anchored to the bottom wall of the channel. Thereafter, a compressible welt cord is compressed so that it will pass through the restricted opening 31 into the channel 18 and effectively cover the outwardly exposed ends of the plural staples 37. In addition, the welt cord 38 will expand after passing the restricted opening 31 to occupy the majority portion of the channel 18 to effectively hold the edge portion 36 of the upholstery 16 in the channel 18. As a result of this connection, the staples 33 and 37 are no longer exposed.

Figure 4:
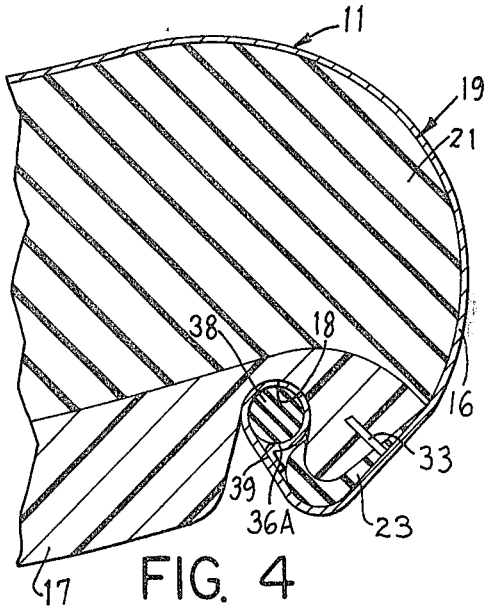
FIG. 4 is a sectional view, similar to FIG. 3, but showing an alternate structure for securing the upholstery to the body supporting frame.

The same general type of construction is illustrated in FIG. 4. As a result, the same reference numerals have been used to identify corresponding components. However, the modified portions of the construction have been identified, where possible, by the same reference numeral used to describe similar structure in FIG. 3 but with the suffix "A" added thereto. The edge 36A of the upholstery 16 is, in this particular embodiment, wrapped around the welt cord 38 and secured by an adhesive as at 39 to the inside surface of the upholstery. This construction will generally require the preassembly of the upholstery 16 with the welt cord located at the peripheral edge thereof by following a predesignated pattern. Since the molding technology produces a fairly accurate body supporting frame member 17, the location of the channel 18 relative to the lateral edge of the frame 17 will be fairly accurate and it will be possible to provide a taut upholstery 16 on the seat portion 11 through the use of the preassembly technique. It is to be noted that the elongated strip is required for the embodiment of FIG. 4 to define the aforesaid restricted opening 31.

Figure 5:
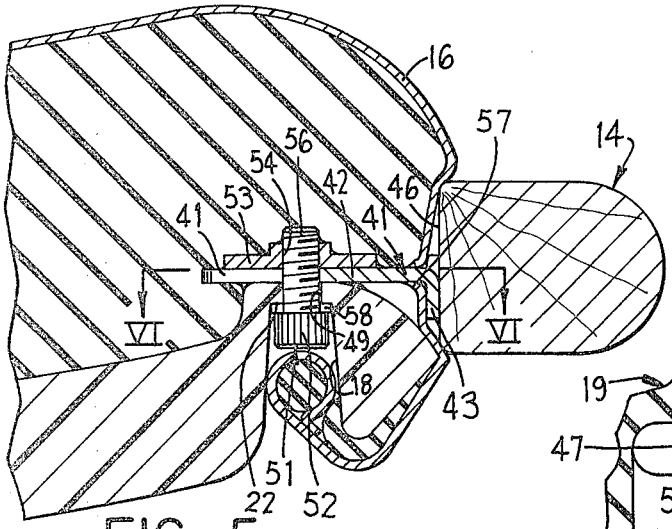
FIG. 5 is a sectional view illustrating the structure for effecting a securement of an appendage, namely, an arm, to the chair.

FIG. 5 illustrates the preassembled upholstery structure shown in FIG. 4 for effecting a securement of the upholstery 16 to the frame 17. However, in FIG. 5, the cross section is taken at the location where a bracket member 41 is secured to an arm 14, which bracket member is in turn also secured to the frame 17. More specifically, the bracket member 41 is generally T-shaped having a stem portion 42 and a cross portion 43. The cross portion 43 has a pair of aligned openings (not illustrated) therethrough which are adapted to receive screws 44 to effect a securement of the cross portion 43 to the inside surface 46 of the arm 14. The stem portion 42 extends laterally away from the inside surface 46 of the arm 14 and has a bifurcated end segment composed of two parallel and spaced apart legs 47 and 48.

Figure 6:
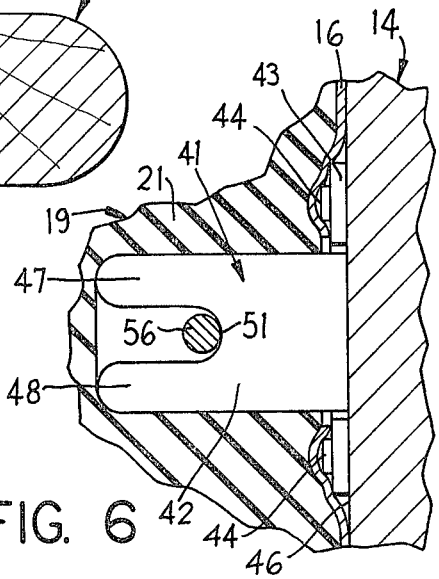
FIG. 6 is a sectional view taken along the line VI—VI of FIG. 5.

A hole 49 is provided in the bottom wall 22 of the channel 18. It will be noted that at this particular location in the channel 18, the depth of the channel is slightly greater than the depth illustrated in FIGS. 3 and 4. The reason for this difference in depth will be apparent hereinbelow. More specifically, the externally threaded shank portion of a screw 51 having an enlarged head 52 thereon is received in the hole 49 and between the legs 47 and 48 on the bracket 41. A nut 53 having an internally threaded opening 54 therein is adapted to receive the externally threaded portion 56 of the shank of the screw 51 therethrough. A rotation of the screw 51 in one direction, for example, will draw the nut 53 toward the frame 17 and effectively clamp the stem portion 42 of the bracket 41 between the nut 53 and the frame 17. Since the spacing between the legs 47 and 48, as illustrated in FIG. 6, is greater than the diameter of the externally threaded portion 56 of the screw 51, it will be very easy for the assembler to locate the bracket 41 relative to the hole 49 and screw 51. In other words, the assembler can locate approximately the location of the hole 49 and screw 51, thereafter slit the upholstery 16 as at 57, and cause the stem portion 42 to extend through the opening 57 so that the legs 47 and 48 straddle the screw 51. Thereafter, the screw can be tighened to effectively clamp the stem portion 42 between the nut 53 and the frame 17. It will be recognized that during this particular assembly, the welt cord 38 will have to be temporarily removed to enable a tightening of the connection between the arm 14 and the frame 17. However, a replacement of the welt cord into the channel 18 will effectively draw the upholstery taut and, simultaneously, cover the head 52 of the screw 51.

If desired, a washer 58 or the like can be utilized between the underside of the head of the screw 52 and the material of the frame 17. Oftentimes thermoplastic material will become deformed if too much pressure is concentrated at a small location thereon. The use of, for example, an elongated rectangular washer plate extending along the bottom wall 22 of the channel 18 will effectively distribute the force applied by the screw 51 over a substantially greater area to thereby minimize the likelihood of the screw deforming the material of the frame 17.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A connection for securing an appendage to an article of furniture, said connection comprising:

body supporting frame means including a continuous channel extending about and having a width dimension crosswise of the longitudinal extent of said channel and adjacent the outer part of said channel that is at least equal to or greater than the width of said channel adjacent the bottom thereof;

upholstery covering at least a portion of said body supporting frame means, an edge portion of said upholstery being received in said channel and securing means received in said channel for effecting a securement of said upholstery in said channel to said body supporting frame means;

bracket means defining a bottom wall in said channel, said bottom wall having further means defining a hole therethrough in which is received an elongated first fastener member having a head thereon and at one end thereof, said head lying in said channel, the other end of said first fastener member having releasable coupling means thereon releasably coupled to a second fastener member;

bracket means defining an opening in said upholstery; and a bracket member secured to said appendage and having an extension member thereon extending through said opening in said upholstery and between said first and second fastener members, said first and second fastener members effecting a clamping of said extension member between said second fastener member and said body supporting frame means, said securing means effecting a covering of said head of said first fastener member so that it is not exposed when said article of furniture is fully covered.

2. A chair comprising:

body supporting frame means including a continuous channel extending about and having a width dimension crosswise of the longitudinal extent of said channel and adjacent the outer part of said channel that is at least equal to or greater than the width of said channel adjacent the bottom thereof;

an elongated strip having an angular configured surface on one side thereof conforming to the shape of an outer edge surface of said channel on one side thereof, first means for fixedly securing said angular configured surface to said edge surface, said elongated strip having second means thereon projecting across the width of said channel adjacent said outer part to restrict said opening near said outer part thereof;

compressible welt cord means having a width dimension at least greater than the restricted outer part of said opening;

upholstery covering at least a portion of said body supporting frame means, an edge portion of said upholstery wrapping over and covering said elongated strip to conceal said strip and being received in said channel, said welt cord means being also received in said channel inside of said elongated strip and said restricted outer part, the compressibility of said welt cord means effecting a clamping of the material of said upholstery between said welt cord means and said wall of said channel and a securement of said upholstery to said body supporting frame means;

said bottom of said channel having means defining a hole therethrough in which is received an elongated first fastener member having a head at one end thereof which lies in said channel, the other end of said first fastener member having releasable coupling means thereon releasably coupled to a second fastener member; and said arm having a bracket member with an extension member thereon received between said body supporting frame means and said second fastener member, and first and second fastener means effecting a clamping of said extension member between said second fastener member and said body supporting frame means.

3. The connection according to claim 2, wherein said welt cord means covers said head on said first fastener member so that it is not exposed when said chair is fully covered.

4. The connection according to claim 2, wherein said first fastener member is a screw;

wherein said second fastener member is a nut;

wherein said extension member is bifurcated to define a pair of coextensive legs straddling said screw.

5. The connection according to claim 2, wherein said upholstery includes means defining an opening therethrough through which is received said extension member.

* * * * *